United States Patent [19]

van den Brink

[11] Patent Number: 4,510,558

[45] Date of Patent: Apr. 9, 1985

[54] DEVICE FOR PRODUCING AND PROJECTING LIGHT

[75] Inventor: Hans G. van den Brink, Eindhoven, Netherlands

[73] Assignee: U.S. Philips Corporation, New York, N.Y.

[21] Appl. No.: 576,492

[22] Filed: Feb. 2, 1984

[30] Foreign Application Priority Data

Feb. 21, 1983 [NL] Netherlands ..... 8300632

[51] Int. Cl.[3] ..... F21V 7/20

[52] U.S. Cl. ..... 362/263; 362/264; 362/217; 362/218; 362/267; 362/296; 362/396

[58] Field of Search ..... 362/263, 264, 217, 218, 362/267, 296, 396

[56] References Cited

U.S. PATENT DOCUMENTS 3,703,635 11/1972 Burkarth ..... 362/264 X 3,758,769 9/1973 Pichel ..... 362/264

4,290,097 9/1981 Block et al. ..... 362/264

4,423,348 12/1983 Greiler ..... 362/264 X

*Primary Examiner*—Stephen J. Lechert, Jr.

*Attorney, Agent, or Firm*—Robert S. Smith

[57] ABSTRACT

The device for producing and projecting light has a reflector (11) with an optical center (12), a short arc discharge lamp (13) with lamp caps (21, 22) provided with pins (23 and 24, respectively) and a lamp holder (14) in which the pin (24) of the lamp cap (22) is fixed by fixing screws (26). The lamp holder (14) has a tube (25) which accommodates the pin (24) which is provided with a longitudinal gap (27), in whose proximity and on either side of which is arranged a respective radially directed fixing screw (26). The gap (27) merges into a transverse gap (28) which covers approximately half the circumference of the tube (25). Due to the gaps (27, 28), the tube (25) has obtained parts which behave like rigid springs and keep the fixing screws (26) pressed on the pin (24). FIG. 2.

9 Claims, 5 Drawing Figures

DEVICE FOR PRODUCING AND PROJECTING LIGHT

The invention relates to a device, for producing and projecting light, provided with a concave reflector having an optical center, a short arc discharge lamp arranged with its discharge path near the optical center and a lamp holder for at least mechanically securing the short arc discharge lamp, the lamp comprising a lamp envelope sealed in a vacuum-tight manner, filled with an ionizable gas and having an ovoidal part which encloses the discharge space and two tubular parts extending therefrom at opposite ends thereof, each of which parts accommodates a respective current conductor carrying an electrode at its end located in the discharge space and at its other end being passed out of the lamp envelope and being secured there to a metal lamp cap which is provided with a pin, the lamp holder having a metal tube for receiving the pin of the lamp cap, the wall of said tube being provided with substantially radially directed screws for fixing the pin in the lamp holder.

Such devices are generally known. They are used as search-lights, for scene illumination, or for projecting films. During operation, they draw, dependent upon the lamp type used, a current of a few amperes to much more than 100 A. Consequently, the lamp cap and the lamp holder can become very hot during operation. This effect is further intensified if the current through the lamp passes via the lamp holder. Especially in the latter case it is of importance that also during operation there is an intimate contact between the lamp holder and the lamp cap.

The intimate contact between the lamp cap and the lamp holder is impeded in certain devices by the favct that the lamp holder consists of a metal, for example, nickel-plated brass or copper, other than that of the lamp cap, for example, nickel-plated iron, as a result of which differences in expansion occur. An initially intimate contact can then be lost during operation. Also with the use of the same metal for the lamp holder and the lamp cap, however, large contact resistances can occur during operation.

The invention has for its object to mitigate this disadvantage of known devices and to provide a construction which enables an intimate contact between the lamp cap and the lamp holder to be obtained and to be maintained during operation.

In accordance with the invention, this is achieved in a device of the kind mentioned in the opening paragraph in that the tube of the lamp holder has in its wall a substantially longitudinally extending gap and a respective fixing screw in the proximity of the gap and on either side thereof.

In the known device, two rigid parts, i.e. the tube of the lamp holder and the pin of the lamp cap, are secured to each other by means of the screws in this tube. Due to expansion and flow of the metals and due to vibrations the intimate contact between these rigid parts can be lost. In the device according to the invention, however, a rigid part, i.e. the pin, is secured in a resilient part, i.e. the split tube. The parts of the tube on either side of the gap in fact behave like rigid springs which, even with temperature variation and with difference in expansion of the two metal parts, keep the screws in the tube pressed against the pin and hence also the pin pressed against the inner side of the tube. As a result, an elongate linear contact as well as a number of contact points equal to the number of fixing screws is guaranteed.

In a case in which the tube of the lamp holder is of the same length as the pin of the lamp cap, may be provided with a substantially the tube wall transversely gap into which merges the substantially longitudinal extending gap. In a favorable embodiment, the transverse gap covers aproximately half the circumference of the tube. In a particular embodiment, it is provided such that the longitudinal gap merges approximately at the centre of the tramsverse gap. By providing the transverse gap, the spring rigidity is reduced and can be adjusted to a favourable value.

In certain types of short arc discharge lamps, the lamp cap is provided with a laterally extending cable for connection to a current source. In other lamp types, the current is supplied via the pin of the lamp cap. For the latter lamps, the lamp holder of the device according to the invention in a favorable embodiment is provided with a laterally extending sleeve suitable to fix therein a current supply cable. In a favourable modification, this sleeve is located opposite the longitudinally extending gap in order to obtain a short current path.

At its end remote from the lamp the tube of the lamp holder may be provided with a flange with which the lamp holder is fixed in the device. Another possibility is that at its end remote from the lamp the lamp holder has a pin. This pin may be threaded and may be connected by means of a nut in the device, possibly using a resilient ring. However, the pin may alternatively be fixed in a conventional holder of the kind used in known devices as the lamp holder. In this case, the lamp holder and this conventional holder consist of the same metal or of metals having substantially the same coefficient of thermal expansion.

In order not to fix the lamp excessively in the device, current is supplied to the second electrode in many cases via a cable, and in the case in which the lamp is arranged horizontally in the device, the pin of this second electrode is only supported.

Embodiments of devices according to the invention are shown in the drawings. In the drawings.

Figure 1:
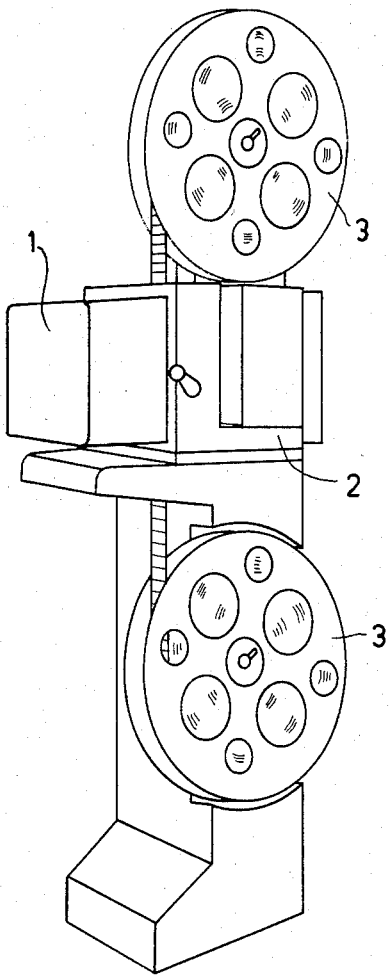
FIG. 1 is a perspective representation of a film projector.

In FIG. 1, the film projector has a lamp house 1, a housing 2 which accommodates a lens system and a film transport mechanism, and film reels 3.

Figure 2:
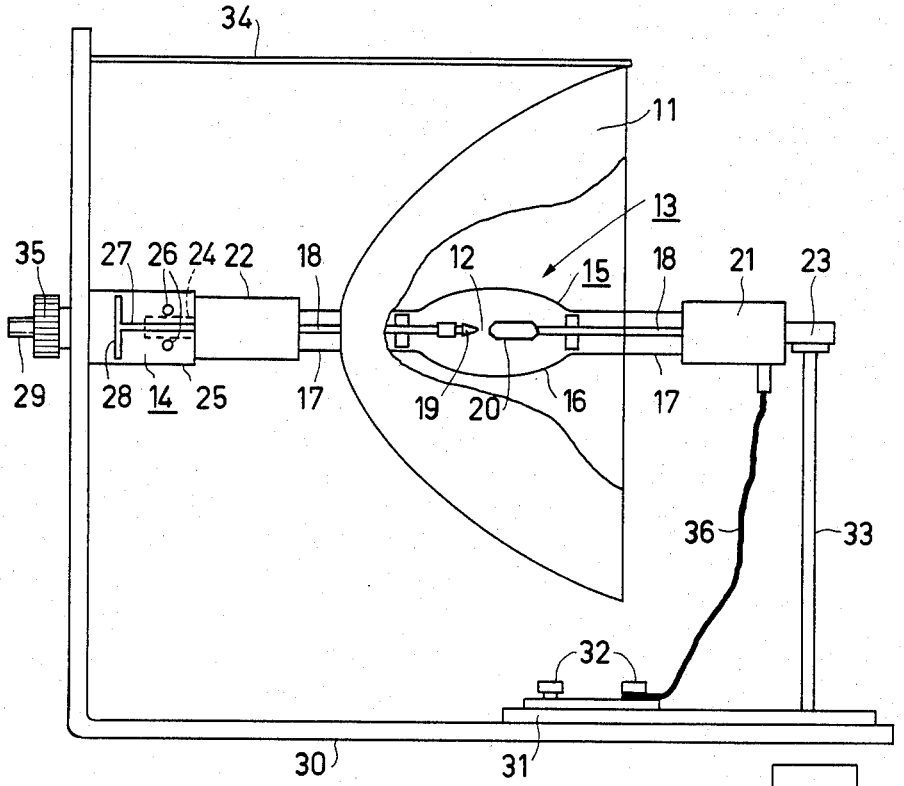
FIG. 2 is a side elevation of the interior of the lamp house of FIG. 1 with the reflector partly broken away.

In FIG. 2, there is arranged in a concave reflector 11 having with an optical centre 12, a short arc discharge lamp 13 with its discharge path, i.e. the space between the electrodes 19 and 20, near the optical centre 12. A lamp holder 14 serves to secure at least mechanically the lamp 13. The lamp 13 has a lamp envelope 15 sealed in a vacuum-tight manner, filled with rare gas and having an ovoidal part 16 and two tubular parts 17 extending therefrom at opposite ends thereof each of which parts accommodates a current conductor 18 carrying at its end located in the discharge space 16 a respective one of the electrodes 19 and 20 (cathode and anode, respectively). At their other ends the current conductors 18 are passed to the exterior of the lamp envelope 15 and are secured there to a metal lamp cap 21 and 22, respectively, which are each provided with a metal pin 23 and 24, respectively.

The lamp holder 14 has a metal tube 25 in which the pin 24 is accommodated and fixed by radially directed screws 26 provided in the wall of the tube.

The tube 25 of the lamp holder 14 has in its wall a substantially longitudinally extending gap 27, in whose proximity and on either side of which is provided a respective fixing screw 26.

The spring rigidity of the split tube 25 is reduced by an substantially transverse gap 28 into which merges the longitudinal gap 27. The gap 28 covers approximately half the circumference of the tube 25, the gap 27 merges into it approximately halfway along its length.

A frame 30 is present which is provided with an insulator body 31 which contacts 32 as well as a support 33 on which bears the metal pin 23 of the lamp cap 21. The lamp cap 21 is connected through a cable 36 to a contact 32. A support 34 holds the reflector 11 in position. At the end of the lamp holder 14 remote from the lamp 13 is provided a threaded pin 29 with a nut 35 by means of which the lamp 13 is secured to the frame 30.

The parts of the tube 25 located between the end of the tube facing the lamp 13 and the gaps 27 and 28 form rigid resilient tags. The screws 26 are advantageously socket head screws. When these screws on the pin 24 have been tightened, these tags have been pressed outwards. The resilient force then produced guarantees an intimate contact between the lamp holder 14 and the pin 24 of the lamp cap 22.

Figure 3:
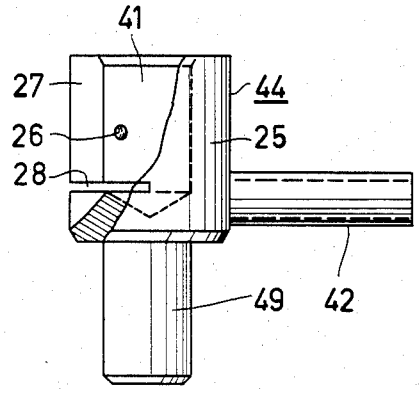
FIG. 3 is a side elevation of the lamp holder of FIG. 2, partly broken away.

In FIG. 3, the lamp holder 44 has a tube 25 having a longitudinal gap 27, a transverse gap 28 and a fixing screw 26. The holder 44 furthermore has a smooth pin 49 opposite a cavity 41 in the tube 25. The cavity is arranged to receive the pin of a lamp cap. The pin 49 can be arranged in a conventional holder. A sleeve 42 extends laterally and serves to fix therein a current supply cable. Thus, the pin 49 need not be current-conveying.

Figure 4:
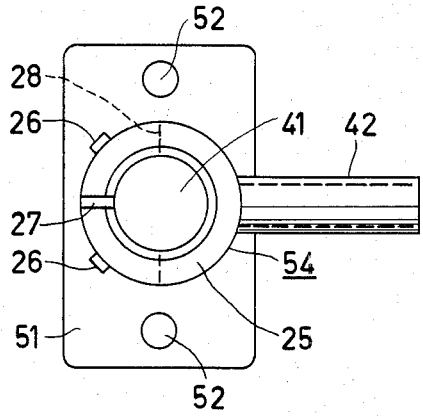
FIG. 4 is a front elevation of a modification of the lamp holder of FIG. 3.

In FIG. 4, a similar holder 54 has a flange 51 with holes for securing it to the device by means of bolts.

Figure 5:
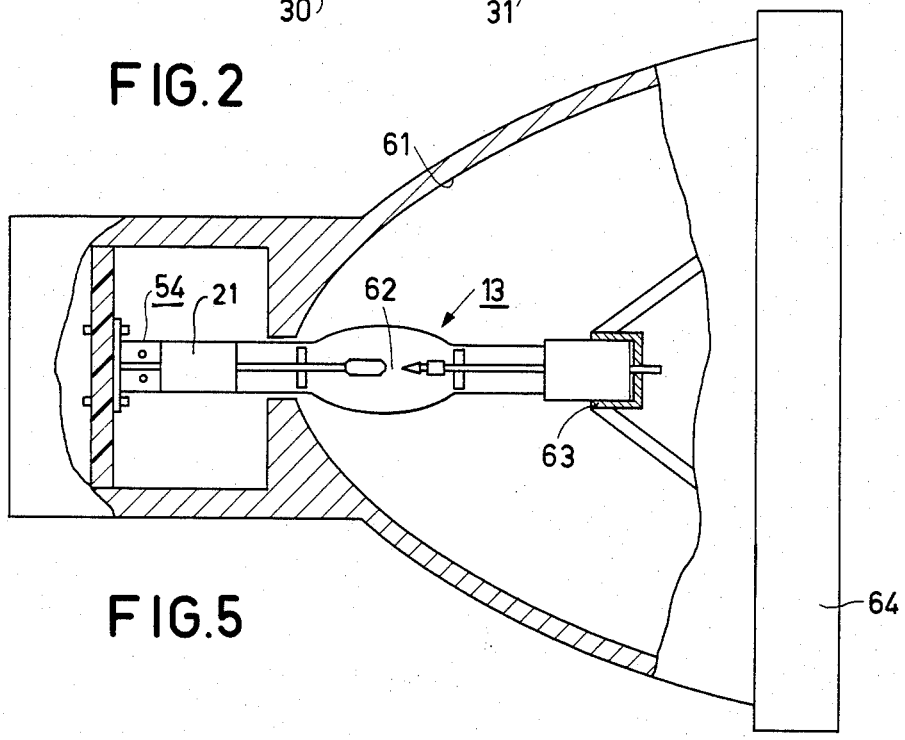
FIG. 5 is a side elevation of a projector for scene illumination, partly broken away.

In FIG. 5, there is arranged in a reflector 61 a short arc discharge lamp 13 (as shown in FIG. 2) with the discharge track in the proximity of the optical centre 62 of the reflector. The lamp 13 is accommodated with a lamp cap 21 in a lamp holder 54 (as shown in FIG. 4), while the other lamp cap is located in a support 63. The reflector is closed by a ring 64 in which a pane is arranged.

What is claimed is:

1. A device for producing and projecting light, provided with a concave reflector with an optical centre, a short arc discharge lamp arranged with its discharge path near the optical centre and a lamp holder for at least mechanically securing the short arc discharge lamp, the lamp comprising a lamp envelope sealed in a vacuum-tight manner, filled with ionizable gas and having an ovoidal part enclosing the discharge space and two tubular parts extending therefrom at opposite ends thereof, each of which parts accommodates a respective current conductor having an electrode at its end located in the discharge space and at its other end being passed out of the lamp envelope and being secured there to a metal lamp cap provided with a pin, the lamp holder having a metal tube for receiving the pin of the lamp cap and in the wall of said tube being provided with substantially radially directed screws for fixing the pin in the lamp holder, characterized in that the tube of the lamp holder has in its wall a substantially longitudinally extending gap, and a respective fixing screw in the proximity of the gap and on either side thereof.

2. A device as claimed in claim 1, characterized in that the wall of the tube of the lamp holder has a substantially transverse gap into which merges the substantially longitudinally extending gap.

3. A device as claimed in claim 2, characterized in that the substantially transverse gap covers approximately half the circumference of the tube and in that the substantially longitudinally extending gap merges at the centre of the transverse gap.

4. A device as claimed in claim 1, characterized in that the lamp holder has a laterally extending sleeve for fixing a current-supply cable in it.

5. A device as claimed in claim 2, characterized in that the lamp holder has a laterally extending sleeve for fixing a current-supply cable in it.

6. A device as claimed in claim 4, characterized in that the sleeve is located opposite the substantially longitudinally extending gap.

7. A device as claimed in claim 5, characterized in that the sleeve is located opposite the substantially longitudinally extending gap.

8. A device as claimed in claim 4, characterized in that the lamp holder on its side remote from the lamp has a pin on which the lamp holder is fixed in the device.

9. A device as claimed in claim 5, characterized in that the lamp holder on its side remote from the lamp has a pin on which the lamp holder is fixed in the device.

* * * * *